United States Patent [19]

Goyal

[11] 3,963,392

[45] June 15, 1976

[54] APPARATUS FOR PREPARING AIR-LAID NONWOVEN WEBS FROM COMBINED STREAMS

[75] Inventor: Prashant K. Goyal, Bombay, India

[73] Assignee: Johnson & Johnson, New Brunswick, N.J.

[22] Filed: Feb. 6, 1975

[21] Appl. No.: 547,914

Related U.S. Application Data

[62] Division of Ser. No. 347,971, April 4, 1973, Pat. No. 3,895,089.

[52] U.S. Cl. ..... 425/83; 19/145.5; 19/156.3; 156/62.2

[51] Int. Cl.[2] ..... D01G 25/00; B29C 13/00

[58] Field of Search ..... 425/80–83; 264/89, 90; 19/156.3, 156.4, 145.5; 156/62.2

[56] References Cited

UNITED STATES PATENTS

| | | | |
|---|---|---|---|
| 3,395,426 | 8/1968 | Langdon | 19/156.3 |
| 3,535,187 | 10/1970 | Wood | 425/83 |
| 3,768,118 | 10/1973 | Ruffo et al. | 19/156.3 |

*Primary Examiner*—Robert L. Spicer, Jr.

[57] ABSTRACT

A process and apparatus for forming a wide variety of air-laid nonwoven webs, with the apparatus including plural pairs of spaced parallel oppositely rotating lickerins, each pair having a movable divider plate therebetween. The lickerins individualize fibers from separate fibrous sources, which may be similar or dissimilar, and high speed air streams are caused to flow past each individual lickerin, through a mixing zone between each pair of lickerins to form combined streams, and into a common mixing zone above a fiber collecting means to form a composite stream. The individualized fibers are doffed from the lickerins by the high speed air streams and are entrained therein, and divider plates between each pair of lickerins are adjustable through a range of positions for controlling the degree of intermixing of the entrained fibers in the combined streams. A further divider plate is mounted in adjustable relationship with respect to the common mixing zone to control the degree to which the combined streams and entrained fibers intermix in forming the composite stream. The air streams may be generated by a single suction source below the fiber collecting means, or by separate individually controlled suction sources on opposite sides of the further divider plates, which may be individually adjusted to further vary the web that is formed on the fiber collecting means. The further divider plate is preferably removably mounted so that a further material, such as a reinforcing material or an adhesive can be introduced into the composite stream and resulting web, if desired.

11 Claims, 10 Drawing Figures

APPARATUS FOR PREPARING AIR-LAID NONWOVEN WEBS FROM COMBINED STREAMS

This is a division of application Ser. No. 347,971, filed Apr. 4, 1973, now U.S. Pat. No. 3,895,089.

BACKGROUND OF THE INVENTION

This invention relates to an immproved process for air-laying fibers to produce a wide variety of air-laid non-woven webs, and to an apparatus upon which such a process may be preformed. Preferably, the webs produced by the process and apparatus of the invention comprise a blend of long and short fibers; i.e., textile length and papermaking fibers, with the fibers of the webs being randomly oriented.

Fibers are usually classified according to length, with relatively long or textile length fibers being longer than about ¼ inch and generally between ½ and 2½ inches in length. The term "long fibers" as used herein, refers to textile fibers having a length greater than one-fourth inch, and the fibers may be of natural or synthetic origin. The term "short fibers," as used herein, refers to papermaking fibers, such as wood pulp fibers or cotton linters having a length less than about ¼ inch. While it is recognized that short fibers are usually substantially less costly than long fibers, it is also recognized in many instances that it is desirable to strengthen a short fiber product by including a blend of long fibers therein.

Nonwoven materials are structures which in general consist of an assemblage or web of fibers, joined randomly or systematically by mechanical, chemical or other means. These materials are well known in the art, having gained considerable prominence within the last twenty years or so in the consumer market, the industrial commercial market and the hospital field. For example, nonwoven materials are becoming increasingly important in the textile and related fields, one reason being because of their low cost of manufacture for a given yardage as compared to the cost of more conventional textile fabrics made by weaving, knitting or felting. Typical of their use is hospital caps, dental bibs, eye pads, dress shields, shoe liners, shoulder pads, skirts, hand towels, handkerchiefs, tapes, bags, table napkins, curtains, draperies, etc. Generally speaking, nonwoven materials are available today in a wide range of fabric weights of from as little as about 100 grains per square yard to as much as about 4,000 grains or more per square yard.

Nonwoven materials are basically one of two types — oriented or random webs. As the name implies, oriented webs have the major proportion of the fibers aligned predominantly in one direction, generally the "machine" or long direction (MD) of the fibrous web so that the properties of the resulting web are asymmetrical or aniosotropic — i.e. conventionally the tensile strengths in the machine direction are generally approximately eight or more times higher than in the cross direction (CD); while on the other hand, random fibrous nonwoven webs do not have the fibers lying predominantly in any direction so that the resulting web is more balanced or isotropic — e.g. the tensile strengths in both the machine and the cross direction are approximately the same. As will be readily appreciated, the uses of oriented nonwoven webs are quite restricted as compared to random webs in that their principle strength lies only in one direction making them unsuitable where a product must have good strength characteristics in all directions.

Many different processes and apparatus are known in the art for producing nonwoven webs; briefly summarized, they may be classified as (1) mechanical techniques (e.g. by carding, garnetting, filament winding), (2) extrusion techniques (e.g. filament extrusion), (3) wet laying techniques (e.g. inclined wire paper apparatus, cylinder paper apparatus, etc.) and (4) air-laying techniques. This invention concerns improvements in the latter classification — i.e. the air-laying techniques, to produce improved random air-laid nonwoven materials.

In brief summary, conventional air-laying techniques for producing nonwoven materials involve opening of fibers from a compressed state, dispersing the fibers in a single high velocity air stream and subsequent condensing (i.e. depositing) of the fibers onto a perforated cylinder or wire screen or belt to produce a web. Thereafter, the web is generally post-treated to provide the required degree of coherency by one or more well known steps, e.g. mechanical or chemical bonding procedures.

In general, air-laying techniques of producing nonwoven webs have several advantages over other types of known web processes in its ability to produce a wide variation of lengths and fineness of webs with a wide range of fabric weights, and as well to permit the use of short fibers for different types of products.

Notwithstanding the advantages of air-laying procedures, the present state of technology for producing random nonwoven webs, insofar as their production speeds are concerned, is inferior to other processes for producing nonwoven webs. By way of example, a method that has been used to blend a mixture of long and short fibers into a non-woven web of randomly oriented fibers involved the step of introducing a mixture of preopened long and short fibers to a single lickerin where the mixture of long and short fibers is individualized. The individual fibers, but still in admixture, are introduced into an air stream and conveyed to a condenser where they were formed into a web. This method has a significant disadvantage in that in order to prevent degradation of the long fibers, it is necessary to operate the lickerin at optimum speed for the long fibers, which is much below that which is optimum for short fibers. This necessary compromise seriously limited the rate at which the fibers could be processed through this system and this economic disadvantage militates against its use. Also, this method is capable of producing only a single type of web, i.e., a web comprised of a homogeneous blend of long and short fibers.

Another prior art apparatus used to make a nonwoven web that is intended to be a homogeneous mixture of randomly oriented long and short fibers includes the use of a milling device, such as a hammer mill, to individualize the short fibers and a lickerin to individualize the long fibers. The individualized short fibers are entrained in an air stream leading to a mixing zone into which the long fibers are introduced, where the fibers are intermixed. The mixture of fibers is deposited on a condenser to form a web of a random mixture of long and short fibers. In these webs, the intermixed fibers are not completely homogeneously blended; in fact, in such webs, there is more or less of a stratification of the fibers in layers, with the long fibers predominating on one side of the web and the short fibers predominating on the other side. A particular disadvantage of this apparatus was that the hammer mill did not completely individualize the wood pulp fibers and, in consequence, clumps of fibers and/or "salt" resulted. Also, only a single type of web can be produced by this approach.

Langdon U.S. Pat. No. 3,512,218, granted May 19, 1970, and Wood U.S. Pat. No. 3,535,187, granted October 20, 1970, disclose apparatus for producing layered, nonwoven webs, wherein the layers are apparently separated by a thin interface of blended fibers from each layer.

A recent development in this field of air-laying webs has overcomme a number of the aforementioned problems in the apparatus previously used and makes possible production of a nonwoven web of a homogeneous mixture of long and short fibers, free from consequential amounts of clumps and "salt". The apparatus and method of this development are described and claimed in a commonly owned United States application Ser. No. 108,547, filed Jan. 21, 1971, now U.S. Pat. No. 3,772,739, in the name of Ernest G. Lovgren.

In the Lovgren apparatus and process, long and short fibers to be blended are individualized separately and simultaneously by separate high speed lickerins, one for each type of fiber, that are operated at speeds optimum for the specific fibers acted upon. For example, in the case of pulpboard, the lickerin is operated in the order of 6,000 rpm to individualize the wood pulp fibers, and the long fibers, the staple length fibers, for example, rayon, are individualized by the lickerin acting on these fibers, operated at a speed in the order of 2,400 rpm. At a speed of 6,000 rpm, rayon fibers are damaged.

In the Lovgren apparatus, individualized fibers are doffed from their respective lickerins by separate air streams. The fibers are entrained in the separate air streams and the air streams are subsequently intermixed in a mixing zone to homogeneously blend the fibers entrained therein. The homogeneous blend of fibers is then deposited in random fashion on a condenser disposed in proximity to the mixing zone. The air streams generated by the high speed operation of the lickerins and by a suction fan located in the condenser, which acts to draw air past the lickerins, convey the fibers to the condenser.

While the Lovgren apparatus represents a substantial advance in the art, the apparatus has limitations in that it does not lend itself for use in making a wide variety of webs.

In accordance with a still further recent improvement, as described and claimed in a commonly owned United States application Ser. No. 108,545 filed in the name of Allan P. Farrington on Jan. 21, 1971, now U.S. Pat. No. 3,740,797, flexible process and apparatus are described for producing a wider variety of nonwoven, air-laid isotropic webs made up of a substantially uniform mixture of long and short fibers, or of two different kinds of long or short fibers. In accordance with the Farrington process, the following types of webs can be produced: (1) a web comprised of a homogeneous blend of fibers from two different fiber sources, (2) a web having outer layers comprised of fibers from two different fiber sources and an intermediate layer that is a blend of the fibers from each source, and (3) a web of two layers of fibers from each fiber source, with the layers being interlaced only at the region of their interface.

In yet another recent development, a still further improvement is disclosed for not only producing webs having greater uniformity, but also non-laminated webs having different properties at their opposite faces. Two similar webs [(2) and (3)] have been produced by the Farrington invention, as summarized in the preceding paragraph, but such webs do not obtain the different properties by a blend of fibers at the opposite faces. In accordance with the teachings in commonly owned United States application Ser. No. 108,546 filed in the name of Angelo P. Ruffo and Prashant K Goyal on Jan. 21, 1971, now U.S. Pat. No. 3,768,118, a web is produced from two different types of fibers at a given overall concentration, with the concentration of each fiber type being increased above the overall concentration at opposite faces, and with the concentration of each fiber type gradually decreasing away from the face at which the overall concentration is increased to the opposite side of the web. Ruffo et al also discovered that by providing an air-to-fiber volume ratio substantially in excess of those provided in the Lovgren and Farrington applications, i.e. in the range of about 12,000:1 to 275,000:1 in the combined air stream, extremely uniform webs can be produced at high production speeds up to 550 feet per minute or greater. These webs were of the type described above in this paragraph, or the type described in the preceeding paragraph.

While the Lovgren, Farrington and Ruffo et al applications all disclosed significant advances in the art, there remains a need for an apparatus and process for producing a wider variety of high quality webs at greater throughputs, and this need is satisfied by the process and apparatus of the present invention. Since the present invention is related to the inventions disclosed in the Lovgren, Farrington and Ruffo et al applications, the disclosures thereof are expressly incorporated herein by this reference to the extent that they are not inconsistent with the express teachings thereof.

SUMMARY OF THE INVENTION

The present invention provides a novel apparatus and process for producing a wide variety of webs by varying the feed of raw fiber materials which are fed to a plurality of uniquely arranged fiber openers and by controlling the flow of the fibers to the point where they are deposited on a fiber collection means.

The apparatus includes a plurality of pairs of adjacently spaced, oppositely rotating lickerins mounted on a common frame, with there being a fiber feed mechanism in the form of a nose bar and feed roll associated with each lickerin. The specific lickerins, nose bars and feed rolls will be selected for optimum opening conditions for the specific fiber being processed, and the individualized fibers from each fiber source are initially entrained in a first combined gaseous stream generally below the lickerin pairs, and ultimately in a further composite combined stream immediately above a fiber collection means. A divider plate or baffle is movably mounted between the lickerins of each pair, so that the fibers doffed from each lickerin of the pair can be either fully blended, partially blended, or substantially blended. The apparatus also includes an inlet slot in the region where each of the combined streams from the various lickerin pairs converges to form the composite combined streams, and the nature of the web that is ultimately produced is controlled by the step of introducing a web influencing means through this slot.

The web influencing means may be in the form of a movable divider plate or baffle that may be adjustably positioned and selectively located so as to allow the combined streams to freely intermix with one another and form the composite stream, or to partially or completely interfere with the intermixing of the combined streams and thereby vary the nature of the composite stream. The web influencing means may also take the form of a further medium, such as a reinforcing medium (scrim, gauze, etc.) or an adhesive medium in the form of a liquid or a powder.

In a specific embodiment including two pairs of lickerins, planes passing through the center lines of each pair subtend an included angle of between 120° to 145°. The divider plate of each lickerin pair is movable perpendicularly with respect to the plane through the center lines of the lickerins with which it is associated and, these divider plates are positioned at an acute angle with respect to one another. The slot through which the further divider plate or further medium is introduced is vertically disposed on the center line of the machine, i.e., in alignment with the line of intersection between the planes which pass through the center lines of the lickerin pairs. It will be appreciated that with the aforedescribed arrangement, a web may be produced comprised of up to five different types of fibers. The exact nature of the web will, of course, depend upon the location of the various divider plates, the type of further medium (if any) that is introduced through the central slot, and control of the gaseous stream, as discussed below.

The gaseous streams may be generated by a single suction source, but preferably, two independently controllable suction sources are provided so that the trajectories of the fibers in the gaseous streams can be controlled independently of the movable divider plates. With two suction sources, a substantially larger fiber depositing zone is produced, which reduces the tendency of the fibers to be deposited in "shingle" effect. As a result, a more coherent web can be produced.

DETAILED DESCRIPTION

Figure 1:
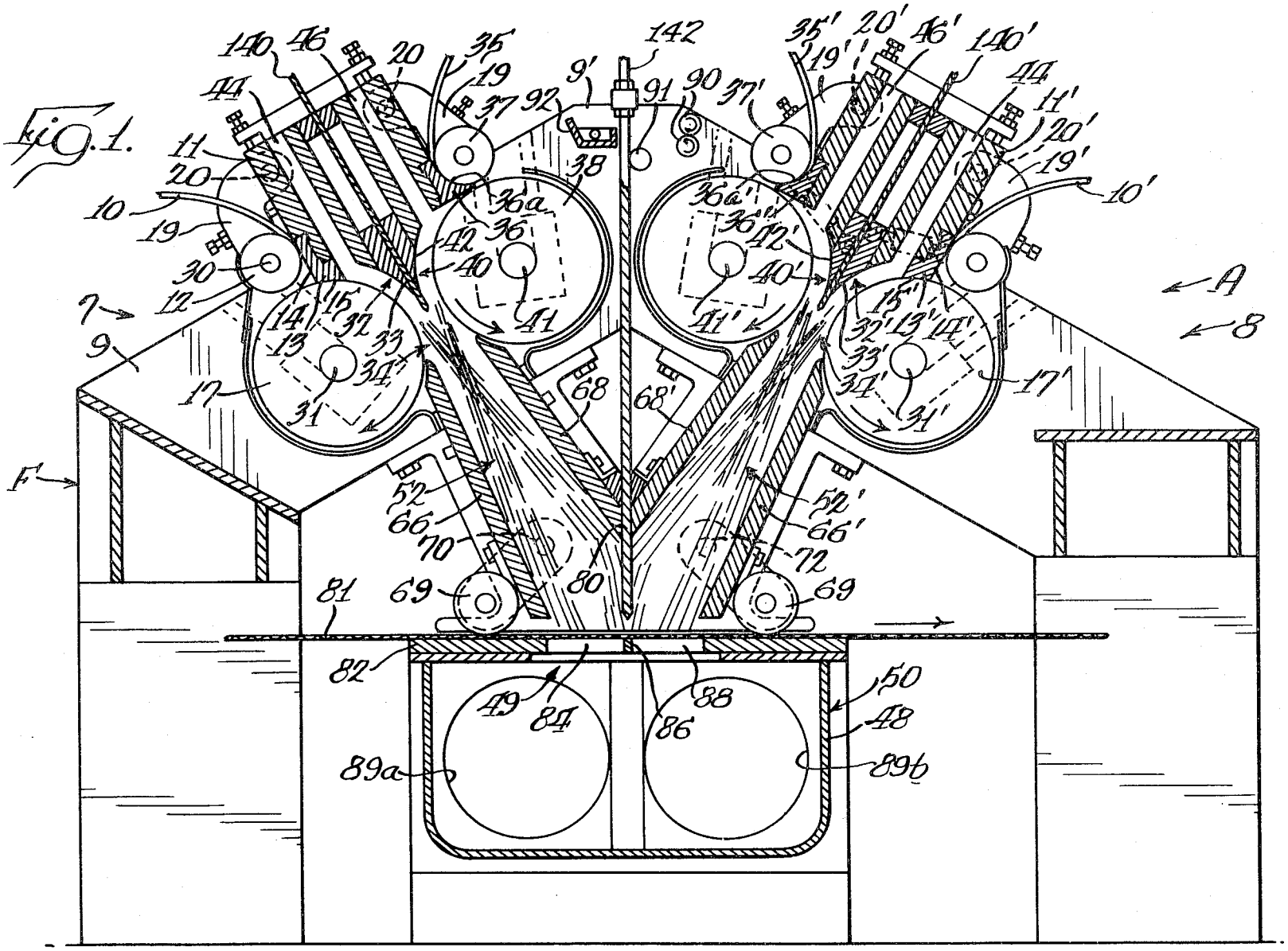
FIG. 1 is a cross-sectional view showing the main components of one embodiment of the apparatus of the present invention, with the central divider plate being shown in a lowered position.

While this invention is susceptible of embodiment in many different forms, there is shown in the drawings and will herein be described in detail a preferred embodiment of the invention, with the understanding that the present disclosure is to be considered as an exemplification of the principles of the invention and is not intended to limit the invention to the embodiment illustrated. The scope of the invention will be pointed out in the appended claims.

Figure 2:
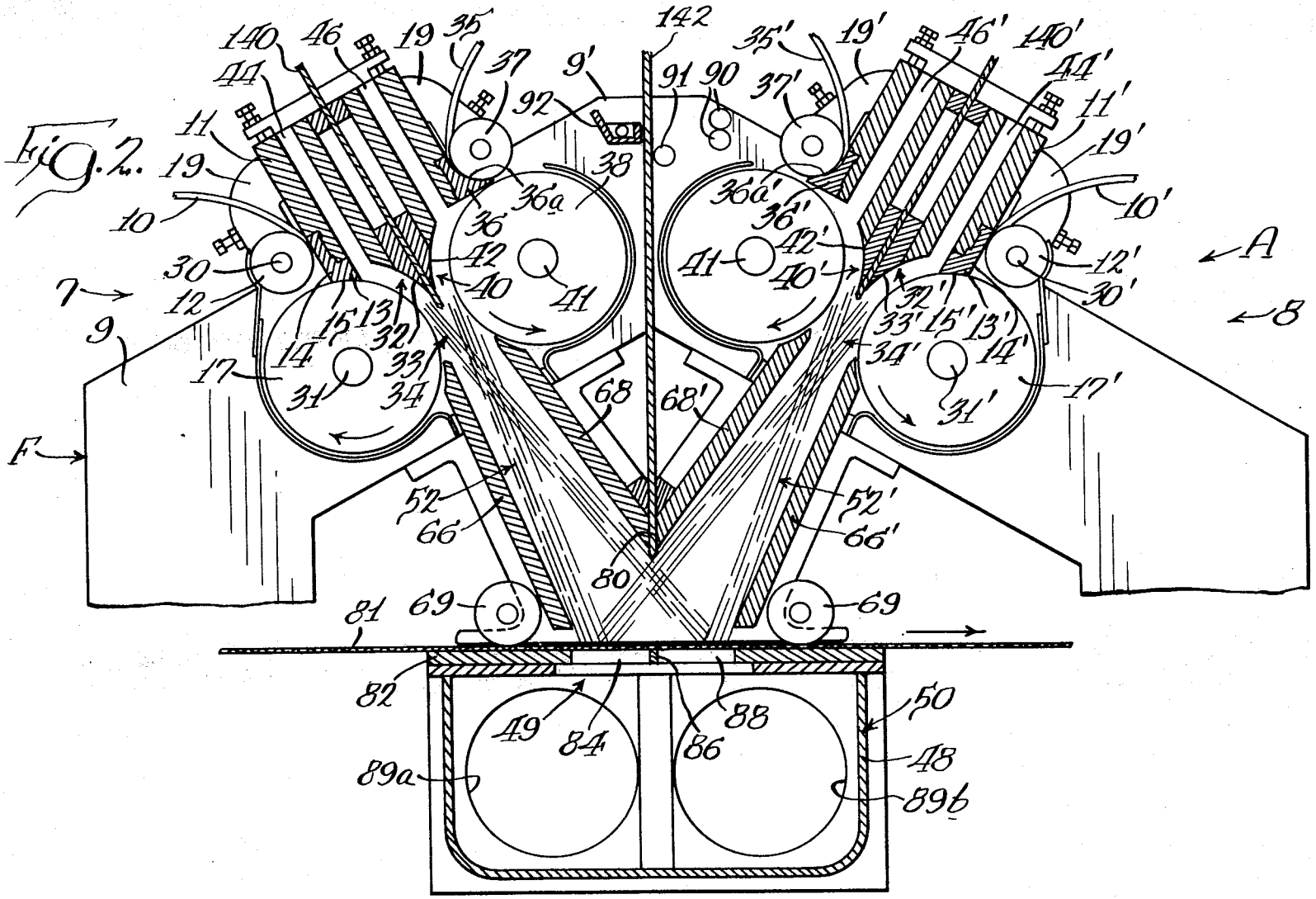
FIG. 2 is a cross-sectional view similar to FIG. 1, but showing the central divider plate in a raised, fully withdrawn position.

Referring now to the drawings, the web forming apparatus is designated in its entirety by reference letter A, and apparatus A includes a main frame F which supports the major components of the apparatus. Frame F includes a pair of spaced, parallel side frame members 9 (one of which is shown in FIGS. 1 and 2), which collectively define a chamber wherein fiber opening means (herein lickerins) individualize fibers from fibrous sources for entrainment of the fibers in high speed gaseous streams and deposition of the fibers on a fiber collection means to form a web. As is evident from FIGS. 1 and 2, side plates 9 converge upwardly to a central horizontally disposed region 9', the center of which defines the center line of web forming apparatus A.

In the illustrated embodiment, a first pair 7 of fiber opening means is located on one side (left hand) of the center line of the apparatus, and a second pair 8 of fiber opening means is located on the other side (right hand) of the center line of the apparatus. As will be evident from the following description, one fiber opening means of each pair is adapted to open or individualize staple or textile length fibers, while the other fiber opening means is adapted to open short or papermaking length fibers. However, it should be understood that this specific arrangement has been chosen for simplicity of description only, and is not in any way intended as a limitation on this disclosure. For example, the present invention contemplates that each fiber opening means of one pair may open the same or different fibers, which may be the same as, or different from the fibers opened by the fiber opening means of the other pair. Hence, while certain components of the apparatus are illustrated and described as having a specific configuration, which has been found to work particularly well for a specific type of fiber, it is not intended that this be limitative on the disclosure, since the specific configuration of the various components of the apparatus will be determined, to a certain extent, by the particular fibers being opened, it being understood that the components should be selected and given the configuration that will result in maximum opening characteristics for the particular fiber being opened.

With the foregoing in mind, since fiber opening pair 8 is essentially the same as fiber opening pair 7 (except for the orientation on frame F), only pair 7 will be described in detail. The same reference numerals used herein to describe pair 7 are also applicable to pair 8, and hence primed reference numerals have been used in the drawings to designate those elements of pair 8 that are the same as those in pair 7.

Referring first to the left-hand, or wood pulp side of pair 7, wood pulp is introduced into the system in the form of pulpboard 10, which is directed between a plate 11 and a wire wound feed roll 12. Connected to the lower part of the plate 11 is a nose bar 13 for providing an anvil against which the pulpboard is directed during the individualizing step. The nose bar 13 has a sidewall 14 that can be made relatively flat, since due to the integrity of the pulpboard, it is unnecessary that the nose bar 13 be designed to more precisely direct the pulpboard to the lickerin 17 that is used to individualize the pulpboard into short fibers. The bottom wall 15 of the nose bar 13 is angularly disposed relative to the sidewall 14 and is spaced a short distance from the teeth of the lickerin 17 to define a passage through which the pulpboard is moved during the individualizing operation. The pulpboard is individualized into short wood fibers by the teeth of the lickerin 17 acting on the pulpboard directed into position to be contacted by the teeth by the nose bar 13.

The feed roll 12 is journalled in a bracket 19 that is eccentrically mounted at 20 to permit adjustment of the feed roll relative to the pulp lickerin 17 and nose bar 13. The bracket 19 and feed roll 12 may be resiliently biased to direct the pulpboard toward the nose bar 13, as described in detail in the above-mentioned Farrington and Ruffo et al applications to insure that the pulpboard is fed into position to be engaged by the lickerin teeth, and to accommodate varying thicknesses of material. The feed roll 12 is secured to a shaft 30 that is suitably supported for rotation by a variable drive means, not shown, the details of which are not important to the present invention. The speed at which the feed roll 12 is rotated is determined by the rate at which pulp is to be fed into the system.

During the operation of the illustrated apparatus, the pulpboard 10 is fed into position to be engaged by the lickerin teeth adjacent the nose bar 13. The lickerin 17 is mounted on shaft 31, which is driven at a very high speed by suitable drive means to individualize the pulpboard into short fibers. In an exemplary embodiment, the lickerin 17 is driven at a speed of 6,000 rpm and produces a large throughput of pulp fibers without adversely affecting the fibers. The lickerin teeth fray the pulpboard until the fibers are loosened therefrom, after which the teeth comb the short fibers out of the board. The clothing on the lickerin is designed to act on the particular fiber and has the optimum tooth profile for the specific material it is processing. Each successive tooth has more opening action than the one before, which facilitates individualizing and when operated at an optimum speed greatly minimizes, if not totally prevents, clumps and salt from being extracted from the board.

The pitch and height of the teeth used on the lickerin for the pulpboard may vary, good results being obtained with a tooth pitch of about 3/32 inch to about one-half inch and a tooth height of about 3/32 inch to about one-half inch. The angle of the teeth of the lickerin for the pulpboard may also vary, generally within the limits of about −10° to about +10°. A positive angle for the teeth of the pulpboard lickerin which is standard in this industry, viz., +10°, may be used in accordance with the invention, but this is not preferred. In general, it is preferred that the angle of the teeth be positive and be below +10°.

After the wood fibers are individualized by the lickerin 17, they are entrained in an air stream and directed through a duct 32 formed between the lickerin 17 and a sidewall 33, which duct 32 leads into a mixing zone 34.

Referring now to the staple length fiberizing system of the pair 7, a number of the mechanisms used in processing the staple length fibers are similar to those used on the pulp side of the system and where they are identical they are given the same numbers.

The staple length fibers, which may be rayon in the form of a carded batt 35, has no integrity and must be positively directed to the clothing of the rayon lickerin 38 to insure that the rayon lickerin teeth will pick the rayon up from a rayon source 35. To this end, the nose bar 36 used with the rayon wire wound feed roll 37 differs from the pulp nose bar 13. The nose bar 36 is curved at **36*a* to essentially conform to the adjacent circumference of the rayon feed roll 37. The rayon fibers picked up from the rayon source are positively maintained in position relative to the feed roll 37 until the fibers are disposed immediately adjacent the teeth of the rayon lickerin 38, which teeth will then serve to comb the fibers from the rayon source. The rayon lickerin is mounted on shaft 41, which is driven at a high speed by suitable means (not shown). A speed which can generally be used without seriously adversely affecting the fibers is 3,000 rpm. The individualized rayon fibers are then air-conveyed into duct 40 located between sidewall 42 and lickerin 38, which duct 40 leads into mixing zone 34**.

The teeth of the rayon lickerin usually have a lower tooth height and pitch than the pulp lickerin. The pitch and height of the teeth used on the lickerin for the rayon may vary, good results being obtained with a tooth pitch of about one-eight inch to about one-fourth inch and a tooth height of about one-eight inch to about one-fourth inch. The angle of the teeth of the lickerin for the rayon may also vary, generally within the limits of about −10° to about +20°.

As is evident from the drawings, lickerins 17 and 38 are disposed in parallel adjacency with respect to one another, and the axes of shafts 31 and 41 lie in a plane that is disposed at an acute angle with respect to the horizontal. Lickerins 17′ and 38′ are mounted in symmetrical relationship relative to lickerins 17 and 38, and the plane passing through the axes of shafts 31′ and 41′ intersects the plane passing through axes of shafts 31 and 41 at the center line of the machine. The abovementioned planes subtend an angle in excess of 45°, preferably in excess of 90°, and most preferably in the range of from about 120° to about 145°.

A divider plate 140 is mounted for movement at right angles with respect to the plane passing through the axes of shafts 31 and 41, and divider plate 140 is movable along a path that substantially bisects the space between lickerins 17 and 38. The means for moving the divider plate 140 may take the form of that disclosed in the abovementioned Farrington application, and the divider plate 140 is movable through a range of positions from a fully withdrawn or retracted position disposed above the plane of the axes of shafts 31 and 41 to a fully extended position disposed a substantial distance below the plane of the axes of shafts 31 and 41. As is described in detail in the abovementioned Farrington and Ruffo et al applications, when plate 140 is in the fully retracted positions, there is no interference with the high speed air streams from ducts 32 and 40, and the fibers in these air streams are impelled toward one another and into mixing zone 34. When divider plate 140 is in the fully extended position, the oncoming high speed streams from ducts 32 and 40 are completely isolated from one another, and there is no blending of the fibers in mixing zone 34. At various positions between the two extremes, the degree of interference with the oncoming air streams is varied, and thus the degree of mixing of the fibers in the oncoming streams can be controlled.

In accordance with the teachings of the abovementioned Ruffo et al application, in order to obtain webs having a high degree of uniformity at high production speeds, the total air-to-fiber volume ratio in the combined stream, i.e. the stream in mixing zone 34 and therebelow, is between about 12,000:1 to about 275,000:1. With this volume ratio extremely uniform webs can be produced at production speeds in excess of 500 feet per minute. Most desirably the volume ratio in each individual stream is within the same ratio — i.e. 12,000 – 275,000:1. In the case where staple length fibers form the total fiber content of the combined stream, the volume ratio in the combined stream preferably has a minimum of from about 15,000:1 to 18,000:1, and up to 275,000:1 (desirably between 100,000:1 and 275,000:1, with each individual stream having similar ratio.

It has been found that at the above-described volume ratios, when divider plate 140 is in the fully retracted position a majority of the fibers coming from duct 40 tend to cross over the fibers coming from duct 32, while a majority of the fibers coming from duct 32 tend to cross over the fibers coming from duct 40. Should a fiber collecting means be positioned immediately below mixing zone 34, the resulting web would have a concentration of short fibers at one face in excess of the overall concentration of short fibers in the web, with the opposite face of the web having a concentration of staple length fibers in excess of the overall concentration of staple length fibers in the web. The concentration of the short and staple length fibers gradually, and generally linearly, diminishes from the respective "enriched" face to the opposite face.

With the lower end of the divider plate positioned slightly below the plane of the shaft axes 31 and 41, at the volume ratios mentioned above, the fibers in the stream coming from duct 32 and duct 40 are substantially homogeneously blended. As will be readily understood, as the divider plate is progressively moved from the fully retracted position to the position slightly below the plane of the shaft axes 31 and 41, the degree of fiber cross over gradually diminishes. When the divider plate is moved below the position for homogeneous blending, fiber cross over is effectively prevented, and as the divider plate is progressively moved downwardly to the fully extended position which effectively completely isolates the oncoming individual streams from one another, the degree of blending gradually decreases. As a result, between these latter two positions webs may be produced having a homogeneously blended core of varying thickness separating layers of blended pulp and rayon layers.

With the foregoing in mind, it will be appreciated that fiber opening pairs 7 and 8 can each produce a wide variety of web combinations. The combined streams from mixing zones 34 and 34' are combined into a further combined stream to form webs of almost unlimited varieties, but before describing several of these webs, the ducting and air flow system of the apparatus will be described in more detail.

The doffing of the fibers from the lickerins 17, 38, the air entrainment of the previously individualized fibers, the conveying of the fibers through the ducts 32, 40 into the mixing zone 34, and the conveying of the intermixed fibers through a further duct 52 to a condenser 50 is accomplished by high velocity air that is introduced into the system by being pulled in through parallel passages 44, 46 by one or more suction fans (not shown). The parallel flow paths 44, 46 lead to lickerins 17, 38, respectively to direct the high velocity air in a uniform flow pattern against the lickerin teeth to doff the fibers clinging thereto. The air with entrained particles therein then flows through ducts 32, 40, respectively, into mixing zone 34 from where it flows through duct 52 to condenser 50. The fiber particles entrained in the air stream are deposited on the condenser in the form of a web.

The condenser 50 on which the fibers are formed into a web consists of an endless movable mesh screen conveyor 81 that is directed over four pulleys, not shown. The conveyor is driven by suitable drive means (not shown) to move from left to right, as indicated by the directional arrows in FIGS. 1 and 2. The conveyor 81 slides over a plate 82 having openings 84 and 86 therein separated by a central partition 88. Plate 82 is disposed above a housing 48, which contains an aperture 49, through which the air is sucked into the housing and through conduits 89*a* and 89*b* that lead to separate and individually controllable suction fans. Sealed wall means may be provided between conduits 89*a* and 89*b*, so that the vast majority, if not all, of the air flowing through the machine can be pulled through slot 84 or 86. Alternatively, plate 82 may be eliminated and a single suction fan provided; but in order to increase the flexibility of the equipment, the two suction fan arrangement is preferred so that the suction pressure and the volume of air being processed through the suction slots 84 and 86 can be varied and controlled.

The two suction fan arrangement may be utilized to control the degree to which the combined streams from ducts 52 and 52' intermix in the mixing zone immediately above screen 81. If divider plate 142 (hereafter more fully described) is completely withdrawn and duct 89*b* completely restricted, the combined stream from duct 52' will have a tendency to deflect toward slot 84 since the air is being pulled through the slot. Since the combined stream from duct 52 is also normally directed toward slot 84, the two combined streams will intermix effectively. By way of contrast, if divider plate 142 is in the fully extended position, and both suction fans are running at about the same rate, the combined streams from ducts 52 and 52' remain substantially separate, and little or no mixing of the combined streams takes place. In summary, the dual suction fan arrangement imparts to the apparatus the ability to control the trajectory of the gaseous stream and the degree of mixing of the fibers therein independently of the divider plates 140, 140', or 142.

It should also be noted that with a two-suction fan arrangement a larger fiber laying area is produced. As is well known in the art, fibers that are deposited in an air laying process tend to build up on one another in generally inclined planes in a shingle-like fashion. With the two-suction fan arrangement, by virtue of the enlarged fiber laying area, the shingling effect is reduced. As a result, more coherent webs can be produced.

The speed at which the conveyor 81 is moved will determine the thickness of the web being formed. For example, the thickness of the web will be increased by decreasing the web take-away speed, and vice versa. The screen conveyor 81 leads to another conveyor belt, not shown, on which the web is carried to another station for further processing, as by the bonding techniques mentioned below.

In order to help seal off duct 52 and maximize the efficiency of the suction fans being used, a pair of slightly diverging plate members 66, 68 are employed to define two outer wall portions of the duct 52 between the lickerins 17 and 38 and the condenser. The lower portion of the ducts 52 and 52' between the plates 66, 68, 66' and 68' and the condenser 50 are essentially sealed off by rollers 69 that are rotatably mounted on pivotally mounted arms 70, 72. The weight of the rollers and arms tends to maintain the rollers in a sealing condition to minimize the introduction of air between the rollers 69 and the plates 66, 68, 66' and 68' and condenser 50.

As is evident from the drawings, plates 68 and 68' converge toward one another and toward the center line of the machine. The lowermost ends of plates 68 and 68' are spaced from one another to define a vertical slot 80 located on the center line of the apparatus, and through which a further web influencing means can be inserted. The further web influencing means may, for example, take the form of a vertically movable divider plate 142, which may be adjusted by any suitable means (not shown) through a range of positions from a fully retracted position (FIG. 2), which allows the combined streams from ducts 52 and 52' to freely intermix with one another, to a fully extended position (FIG. 1) closely adjacent screen 81, where the combined streams from ducts 52 and 52' are effectively isolated from one another. Alternatively, the divider plate 142 may be removed, in which case a further medium could be introduced through slot 80 to form the further wet influencing means. The further medium could take the form of a perforate medium, such as a scrim, nonwoven fabric, porous paper; or of a liquid or powder spray of a treating substance, such as an adhesive, pigment, or the like. Since slot 80 is located on the center line of the apparatus, the further medium will be concentrated primarily in the center of the web that is built upon screen 81. For illustrative purposes, driven feed rolls 90 may be rotatably mounted between side plates 9 for feeding the further medium from a supply source (not shown) over guide roll 91 and through slot 80; or in the instance of a liquid medium, a weir box 92 could be provided between between side plates 9 for discharging the liquid downwardly and through slot 80. Instead of having the divider plate 142 removable, the present invention contemplates that it may be hollow, or slotted, so that in addition to introducing a further medium into the web, the degree of mixing of the combined streams from ducts 52 and 52' can also be controlled. The effect of varying the position of divider plate 142, introducing a further medium through slot 80, and individually controlling the condenser suction fans will be explained in more detail hereinafter.

EXAMPLE I

Figure 3:
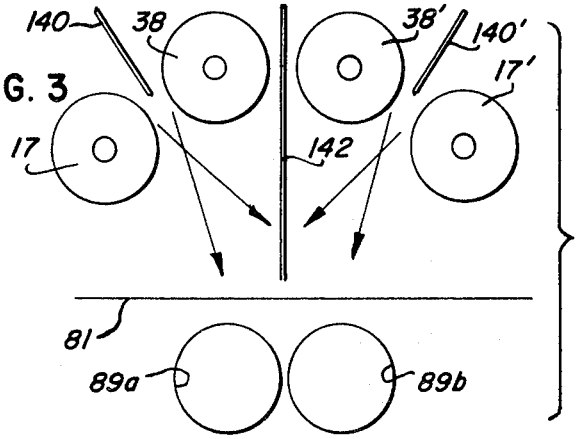
FIG. 3 is a simplified cross-sectional view of the apparatus of the present invention to illustrate its operation with the divider plates for each pair of lickerins in an elevated position and with the divider plate in the web influencing means in a lowered position.
Figure 3A:
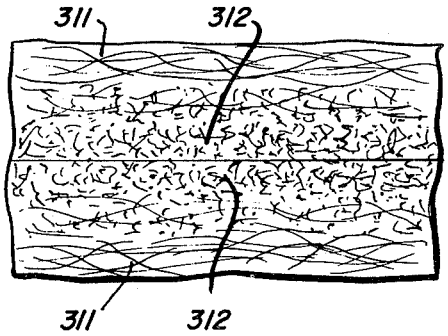
FIG. 3*a* is an enlarged fractional cross-sectional view of the web produced in the operation illustrated in FIG. 3.

A web laying process is carried out in the apparatus of the invention in the position shown in FIG. 3 with divider plates 140 and 140' in the completely withdrawn position and divider plate 142 in the completely extended or down position. The exhaust fans communicating with ducts **89*a* and 89*b* are operated at equal capacity. When pulp is fed to lickerins 17 and 17', and rayon to lickerins 38 and 38' the pulp and rayon fibers cross over one another in mixing zones 34 and 34', and the combined streams are substantially completely isolated from one another by the lower end of divider plate 142. As a result, a web is produced on foraminous screen 81 which, as shown in FIG. 3*a*, has an enriched rayon content at its two outer surfaces and in its outermost quarter-thicknesses 311** with the concentration of rayon progressively decreasing toward the center of the web. The web center has the highest concentration of pulp fibers, with the pulp fiber concentration progressively decreasing toward the web surfaces.

EXAMPLE II

A web laying process is carried out in the apparatus of this invention with divider plates 140 and 140' and divider plate 142 in an intermediate position, a setting for a homogeneous blend. Pulp lickerins 17 and 17' are rotated at 5100 rpm and rayon lickerins 38 and 38' are rotated at 2800 rpm. At each lickerin the nost bar is located at a spacing of 0.020 inches. The fibers are fed to the lickerins at rates to provide a blend of 60% pulp and 40% rayon by weight and the belt is moved at 100 feet per minute to produce a web having a density of 1170 grains per square yard. The web is uniform in composition in all portions of its thickness and the fibers laid on the web are substantially flat so that there is substantially no shingling effect in the web.

EXAMPLE III

Figure 5:
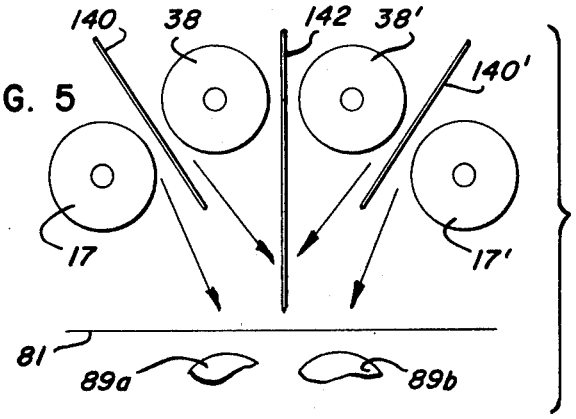
FIG. 5 is a simplified cross-sectional view of the apparatus of the present invention to illustrate its operation with the divider plates for each pair of lickerins in a lowered position and with the divider plate in the web influencing means in a lowered position.
Figure 5A:
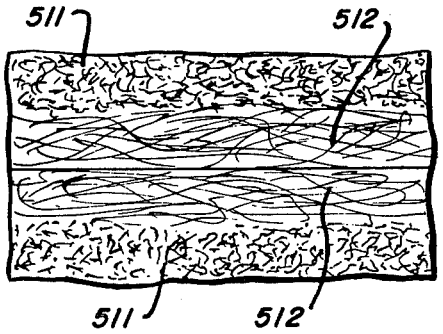
FIG. 5*a* is an enlarged fractional cross-sectional view of the web produced in the operation illustrated in FIG. 5.

A web laying process is carried out in the apparatus of this invention in the position shown in FIG. 5 with divider plates 140 and 140' and divider plate 142 in lowered position. The lickerin speeds, belt speed, nose bar spacings and pulp/fiber ratios are identical to those of Example II. The web produced has a density of 1170 grains per square yard and, as shown in FIG. **5*a* has a predominance of pulp at its outer faces 511 and a rayon-rich inner core 512.**

EXAMPLE IV

This Example is the same as Example I, except that lickerin 38 opens polyester instead of rayon and the resulting web is similar to the web produced with Example I, except that one surface of the web has an enriched polyester fiber content, while the opposite surface of the web has an enriched rayon fiber content.

EXAMPLE V

Figure 6:
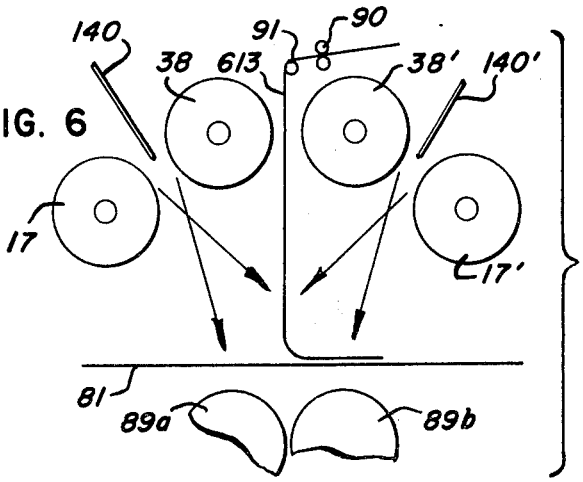
FIG. 6 is a simplified cross-sectional view of the apparatus of the present invention to illustrate its operation with the divider plates for each pair of lickerins in an elevated position and with means provided to introduce a reinforcing material into the composite stream in the web influencing means.
Figure 6A:
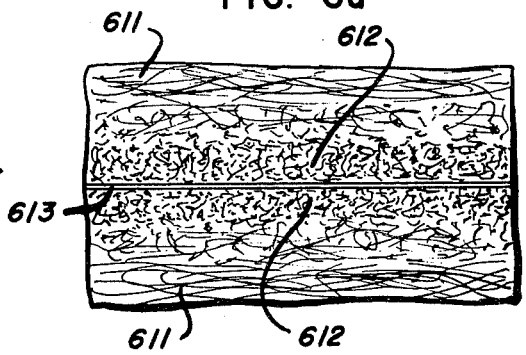
FIG. 6*a* is an enlarged fractional cross-sectional view of the web produced in the operation illustrated in FIG. 6.

This Example is substantially the same as Example I, except that divider plate 142 is removed and scrim is fed through slot 80 by rolls 90, as shown in FIG. 6. The resulting web construction, shown in FIG. **6*a*, is similar to that of Example I, with rayon-rich outer layers 611 and pulp-rich center 612,** the latter being reinforced by scrim in intimate contact therewith.

EXAMPLE VI

Figure 4:
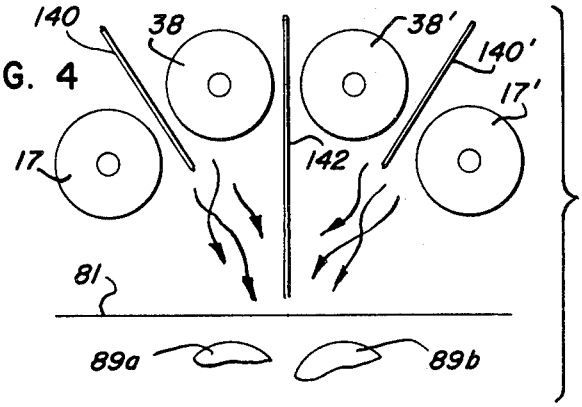
FIG. 4 is a simplified cross-sectional view of the apparatus of the present invention to illustrate its operation with the divider plates for each pair of lickerins in an intermediate position and with the divider plate in the web influencing means in a lowered position.
Figure 4A:
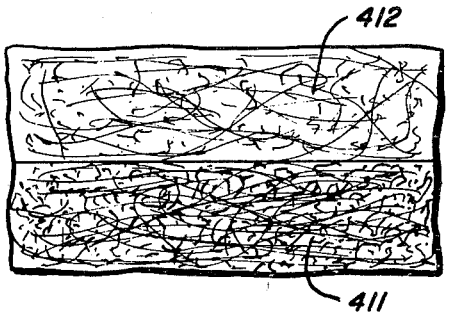
FIG. 4*a* is an enlarged fractional cross-sectional view of the web produced in the operation illustrated in FIG. 4.

This Example is similar to Example I, except that divider plates 140 and 140' are in an intermediate position, as shown in FIG. 4, so that substantially complete intermixing takes place in ducts 89*a* and 89*b*. The exhaust fan communicating with Duct 89 is operated at a higher speed than the fan communicating with duct 89', producing a web layer in the initial portion of the web laying process which is more dense than the web layer produced in the final portion of the web laying process. The final web, shown in FIG. 4*a*, is uniform in rayon/pulp ratio in all portions of its thickness, but its lower layer 411 is more dense than its upper layer 412.

It should be understood that the nonwoven webs obtained by the present invention may be post-treated by any suitable conventional technique, e.g., mechanical or chemical, to bond the web and provide the required strength and coherency characteristics for a given product. The particular type of bonding technique chosen will depend upon various factors well known to those skilled in the art, e.g., type of fibers, the particular use of the products, etc. To this end, typical of the conventional techniques are web saturation bonding, suction bonding, foam bonding, print bonding, fiber bonding, fiber interlocking, spray bonding, solvent bonding, scrim bonding, viscous bonding, mercerization, etc. These techniques are described in more detail in the above-mentioned Ruffo et al application.

It should also be noted that while all of the webs described herein have been described as being deposited directly upon screen 81, the present invention also contemplates that such webs can be condensed upon a suitable carrier member, such as gauze, or an apertured nonwoven fabric.

I claim:

1. Web forming apparatus comprising: frame means; means for feeding a fibrous material to a first fiberizing station at a first location on said frame means; means for feeding a fibrous material to a second fiberizing station at a second location on said frame means; means defining a first mixing zone between said first and second fiberizing stations, said mixing zone having a fiber inlet end and a fiber outlet end; means adjacent the inlet end of said first mixing zone for opening said first mentioned material at said first fiberizing station and producing a supply of individualized fibers that enter said first mixing zone through said inlet end; means adjacent the inlet end of said first mixing zone for opening said second mentioned material at said second fiberizing station and producing a supply of individualized fibers that enter said first mixing zone through said inlet end; means for providing gaseous streams for initially directing said supplies of individualized fibers toward one another and to said first mixing zone; a flow controlling member; means mounting said flow controlling member for movement relative to said first mixing zone to control the extent to which said gaseous streams intermix to produce a first combined gaseous stream; means for feeding a fibrous material to a third fiberizing station at a third location on said frame means; means for feeding a fibrous material to a fourth fiberizing station at a fourth location on said frame means; means defining a second mixing zone between said third and fourth fiberizing stations, said second mixing zone having a fiber inlet end and a fiber outlet end; means adjacent the inlet end of said second mixing zone for opening said third mentioned material at said third fiberizing station and producing a supply of individualized fibers that enter said second mixing zone through its said inlet end; means adjacent the inlet end of said second mixing zone for opening said fourth mentioned material at said fourth fiberizing station and producing a supply of individualized fibers that enter said second mixing zone through its said inlet end; means for providing gaseous streams for initially directing said supplies of individualized fibers toward one another and to said second mixing zone; a second flow controlling member; means mounting said second flow controlling member for movement relative to said second mixing zone to control the extent to which said last mentioned gaseous streams intermix to produce a second combined gaseous stream means defining a third mixing zone between said first and second mixing zones and communicating with the outlet ends thereof, said third mixing zone having a fiber inlet end and a fiber outlet end; third flow controlling member; means mounting said third flow controlling member for movement relative to said third mixing zone to control the extent to which said first and second combined gaseous steams intermix to produce a third combined gaseous stream; and fiber collecting means adjacent the fiber outlet end of said third mixing zone for accumulating fibers to form a web.

2. Apparatus as set forth in claim 1 wherein said fiber opening means include first, second, third and fourth lickerins located respectively at said first, second, third and fourth fiberizing stations; said first and second lickerins being located in parallel adjacency with respect to one another, and said third and fourth lickerins being located in parallel adjacency with respect to one another; and means mounting each lickerin on said frame means for rotation at its respective fiberizing station in fiber removing relationship with respect to its respective fibrous material.

3. Apparatus as set forth in claim 2 including means for moving said first controlling member along a path that bisects the space between said first and second lickerins and means for moving said second controlling member along a path that bisects the space between said third and fourth lickerins.

4. Apparatus as set forth in claim 3 in which said third flow controlling member is generally vertically disposed above said fiber collecting means and is movable generally perpendicularly with respect thereto, said first and second flow controlling members being disposed above said fiber collecting means and at acute angles with respect to said third controlling member.

5. Apparatus as set forth in claim 4 wherein said third and fourth lickerins are also parallel with said first and second lickerins.

6. Apparatus as set forth in claim 1 wherein said means for providing said gaseous streams include suction means beneath said fiber collecting means.

7. Apparatus as set forth in claim 6 wherein said suction means includes first and second individually controllable suction applying means positioned on opposite sides of said third controlling member.

8. Web forming apparatus comprising: frame means; a first pair of spaced parallel lickerins rotatably mounted on said frame means; a second pair of spaced parallel lickerins rotatably mounted on said frame means, the planes passing through the rotational axes of each pair of lickerins converging upwardly and substending an angle in excess of 90°; means for feeding a source of fibers to each of said lickerins; means defining a gaseous flow path past each lickerin, a mixing zone beneath each pair off lickerins, and a further common mixing zone therebelow; a divider plate for each pair of lickerins; means mounting each divider plate on said frame means for movement between the lickerins of its respective pair at right angles with respect to the plane passing through the rotational axes of said lickerins; means defining a vertical slot in said frame means in alignment with the line of intersection of the planes through the rotational axes of said lickerins, said slot being adapted to receive a web influencing means therein; fiber collecting means below said common mixing zone for accumulating fibers thereon to form a web; and means causing high speed gaseous streams to flow along said flow paths and through said fiber collecting means.

9. Apparatus as set forth in claim 8 in which said web influencing means is a divider plate, and wherein means is provided for moving said last mentioned divider plate vertically within said slot.

10. Apparatus as set forth in claim 8 in which said web influencing means in a reinforcing medium, and wherein means is provided for feeding said medium downwardly through said slot.

11. Apparatus as set forth in claim 8 in which said web influencing means is an adhesive substance, and wherein means is provided for dispensing said substance into said slot.

* * * * *

UNITED STATES PATENT AND TRADEMARK OFFICE

CERTIFICATE OF CORRECTION

PATENT NO. : 3,963,392

DATED : June 15, 1976

INVENTOR(S) : Prashant K. Goyal

It is certified that error appears in the above-identified patent and that said Letters Patent are hereby corrected as shown below:

In Column 1:
Line 9, "This invention relates to an immproved", should read---This invention relates to an improved ---
Line 12, "a process may be preformed", should read --- a process may be performed ---

In Column 3:
Line 13,"has overcomme" should read --- has overcome---

In Column 7:
Line 11,"in the form of pulpboard" should read --- in the form of a pulpboard---

In Column 11:
Line 46, "the further wet influencing" should read --- the further web influencing ---
Line 58, "could be provided between between side plates" should read --- could be provided between side plates ---

In Column 14:
Line 15, "ond combined gaseous stream means" should read --- ond combined gaseous stream; means ---
Line 19, ";third flow controlling member;" should read --- ; a third flow controlling member; ---
Line 66/67, "converging upwardly and substending an angle" should read --- converging upwardly and subtending an angle ---

In Column 16:
Line 7, "web influencing means in a reinforcing" should read --- web influencing means is a reinforcing ---

Signed and Sealed this

Nineteenth Day of October 1976

[SEAL]

*Attest:*

RUTH C. MASON
*Attesting Officer*

C. MARSHALL DANN
*Commissioner of Patents and Trademarks*